US008943973B2

(12) United States Patent
Mendes et al.

(10) Patent No.: US 8,943,973 B2
(45) Date of Patent: Feb. 3, 2015

(54) HAND GRENADE, A HAND-GRENADE ACTUATOR, AND A METHOD OF MANUFACTURING A HAND-GRENADE ACTUATOR

(75) Inventors: Ricardo Augusto Mendes, Rio de Janeiro (BR); Rogério Borges Da Cunha, Rio de Janeiro (BR)

(73) Assignee: Condor S.A. Industria Quimica, Rio de Janeiro (BR)

( * ) Notice: Subject to any disclaimer, the term of this patent is extended or adjusted under 35 U.S.C. 154(b) by 232 days.

(21) Appl. No.: 13/702,529

(22) PCT Filed: May 5, 2011
(Under 37 CFR 1.47)

(86) PCT No.: PCT/BR2011/000130
§ 371 (c)(1),
(2), (4) Date: Jun. 24, 2013

(87) PCT Pub. No.: WO2011/153597
PCT Pub. Date: Dec. 15, 2011

(65) Prior Publication Data

US 2014/0013986 A1 Jan. 16, 2014

(30) Foreign Application Priority Data

Jun. 11, 2010 (BR) ..... 1002280

(51) Int. Cl.
*F42B 27/08* (2006.01)
*F42B 12/38* (2006.01)

(Continued)

(52) U.S. Cl.
CPC ..... *F42B 27/08* (2013.01); *F42B 12/387* (2013.01); *F42B 35/00* (2013.01); *F42C 14/02* (2013.01); *F42B 99/00* (2013.01)
USPC ..... 102/487; 102/486

(58) Field of Classification Search
CPC ..... F42C 14/02; F42C 11/003; F42C 15/20; F42B 27/00; F42B 8/26; F42B 27/08; F42B 35/00
USPC ..... 89/482, 486, 487
See application file for complete search history.

(56) References Cited

U.S. PATENT DOCUMENTS 2,356,389 A * 8/1944 Decker et al. ..... 102/487
3,683,814 A * 8/1972 Bedall et al. ..... 102/265

(Continued)

FOREIGN PATENT DOCUMENTS

WO WO 2006/128257 A1 12/2006

OTHER PUBLICATIONS

International Searching Authority, International Search Report and Written Opinion for International Application No. PCT/BR2011/000130, mailed Aug. 16, 2011, 11 pages, European Patent Office, The Netherlands.

(Continued)

*Primary Examiner* — Isam Alsomiri
*Assistant Examiner* — Joshua Freeman
(74) *Attorney, Agent, or Firm* — Alston & Bird LLP

(57) ABSTRACT

The present invention relates to a hand grenade comprising a main body (10), an actuator (14) releasably fixed to the main body (10), an actuator-ejection mechanism, and a charge to be released, which includes an automatic-identification device (34) embedded in the actuator. The invention further relates to a grenade actuator of the EOT-type (Espoleta de Ogiva de Tempo, time fuse point), which comprises an automatic-identification device (34) embedded therein. The present invention can also materialize in the form of a method of manufacturing a hand-grenade actuator, according to which it is provided a housing for an automatic-identification device in the actuator body. Indeed, the method of manufacturing the actuator further in¬ cludes providing said housing with a cylindrical shape and then inserting an equally cylindrical automatic-identification device into said housing.

9 Claims, 4 Drawing Sheets

(51) Int. Cl.

| | |
|---|---|
| ***F42B 35/00*** | (2006.01) |
| ***F42C 14/02*** | (2006.01) |
| ***F42B 99/00*** | (2006.01) |

(56) References Cited

U.S. PATENT DOCUMENTS

| | | | | |
|---|---|---|---|---|
| 3,731,632 | A * | 5/1973 | Stevens | 102/365 |
| 3,765,337 | A * | 10/1973 | Padula | 102/487 |
| 3,782,288 | A * | 1/1974 | Berlin et al. | 102/487 |
| 3,823,670 | A * | 7/1974 | Zacharin | 102/487 |
| 4,383,468 | A * | 5/1983 | Sie et al. | 86/1.1 |
| 4,506,606 | A * | 3/1985 | Caruso | 102/487 |
| 4,699,063 | A * | 10/1987 | Aschwanden et al. | 102/498 |
| 4,773,330 | A * | 9/1988 | Losfeld | 102/487 |
| 5,085,147 | A * | 2/1992 | Gold et al. | 102/486 |
| 5,196,649 | A | 3/1993 | DiRubbio et al. | |
| 5,886,288 | A * | 3/1999 | Brunn | 102/482 |
| 6,349,650 | B1 * | 2/2002 | Brunn et al. | 102/368 |
| 7,963,227 | B1 * | 6/2011 | Brunn | 102/498 |
| 8,025,011 | B1 * | 9/2011 | Yafai et al. | 102/487 |
| 8,122,830 | B2 * | 2/2012 | Moore | 102/293 |
| 8,453,573 | B1 * | 6/2013 | McKimm et al. | 102/487 |
| 8,661,979 | B2 * | 3/2014 | Veksler | 102/256 |
| 2003/0167953 | A1 * | 9/2003 | Teilhol et al. | 102/487 |
| 2006/0236889 | A1 * | 10/2006 | Bodley et al. | 102/487 |
| 2011/0290144 | A1 * | 12/2011 | Muller et al. | 102/482 |
| 2013/0125773 | A1 * | 5/2013 | Brunn | 102/334 |
| 2013/0186295 | A1 * | 7/2013 | Kravel, Jacob | 102/487 |
| 2013/0239838 | A1 * | 9/2013 | Kravel, Jacob | 102/487 |

OTHER PUBLICATIONS

International Preliminary Examining Authority, International Preliminary Report on Patentability, including Applicant's Amendments Under Article 19, for International Application No. PCT/BR2011/000130, mailed Aug. 17, 2012, 8 pages, European Patent Office, Germany.

* cited by examiner

HAND GRENADE, A HAND-GRENADE ACTUATOR, AND A METHOD OF MANUFACTURING A HAND-GRENADE ACTUATOR

CROSS REFERENCE TO RELATED APPLICATIONS

This application is a national stage application, filed under 35 U.S.C. §371, of International Application No. PCT/BR2011/000130, filed May 5, 2011, which claims priority to Brazilian Patent Application No. PI1002280-5, filed Jun. 11, 2010, both of which are hereby incorporated by reference in their entirety.

BACKGROUND OF THE INVENTION

1. Related Field

The present invention relates to a hand grenade, the application of which may be directed to a number of purposes, such as explosive grenades, smoke grenades, tear-gas grenades or pyrotechnical grenades. More specifically, the present invention relates to a grenade arrangement that enable one to locate the artifact or fragments associated to it after it has been actuated.

2. Description of Related Art

As it is well known, there is a diversity of grenades, the function characteristics of which are directly associated to the effect for which the artifact is intended.

However, regardless of the intended application, since this is a war artifact, the transportation, storage and use of grenades are usually controlled by the competent authorities.

For this purpose, the usual procedure for such control consists in identifying the grenade with serial numbers engraved onto the grenade bodies, which are linked to distribution listings.

With this control, one intends to indentify the grenade arsenals manufactured, transported, stored and used by each of the subjects involved in the operations that require the use of this instrument.

However, exactly because this is a piece of equipment that in most cases explodes when it is used, the task of identifying this artifact after it has been used is excessively hard and often impossible to complete.

There is the possibility that the markings printed on the grenade body will be scratched out so as to hide the information relating to the origin of the artifact.

In both cases, there is an undesirable factor of uncertainty in the activities that involve a potentially dangerous armament.

Thus, it is a desire of the market to provide grenades and other similar artifacts that, even after its use, can be duly identified, as a way of ensuring its origin and, furthermore, the potential users of the equipment.

More specifically, one desires a grenade that facilities the distribution logistics task, from the manufacture of the equipment to the delivery thereof to the final recipient, as well as enabling effective traceability thereof, even after it has been detonated.

BRIEF SUMMARY

In order to achieve these objectives satisfactorily, the present invention provides a grenade having a main body, an actuator, an actuator-ejection mechanism, and a load to be released. Furthermore, according to present invention, the grenade is characterized by having an automatic-identification device imbedded in the actuator body.

Besides the present invention provides a grenade actuator, the main characteristic of which consists in having an automatic-identification device.

In the preferred embodiment of the present invention, once the grenade has been actuated, the actuator is ejected from it, so that, in the case of an explosive charge, it will not be destroyed by the detonation of the artifact, and the automatic-identification device remains intact.

Thus, it is possible, even after detonation of the grenade, and with the adequate means, to trace down and identify positively the automatic-identification device present on the actuator. Such an automatic-identification device may include, for instance, a radiofrequency-identification means, also called RFID for short.

In order to make the identification with an RFID-means, it is just necessary to scan with a RFID-reader, the area where the actuator could be located, taking into consideration the grenade-detonation site.

Another embodiment of the invention consists of a method of manufacturing a hand-grenade actuator according to which housing is provided for the automatic-identification device on the actuator body, and then an equally cylindrical automatic-identification device is inserted into said housing.

BRIEF DESCRIPTION OF THE FIGURES

The present invention will now be described in greater detail, but only by way of example, with reference to the attached drawings, in which.

DETAILED DESCRIPTION OF VARIOUS EMBODIMENTS

Figure 1:
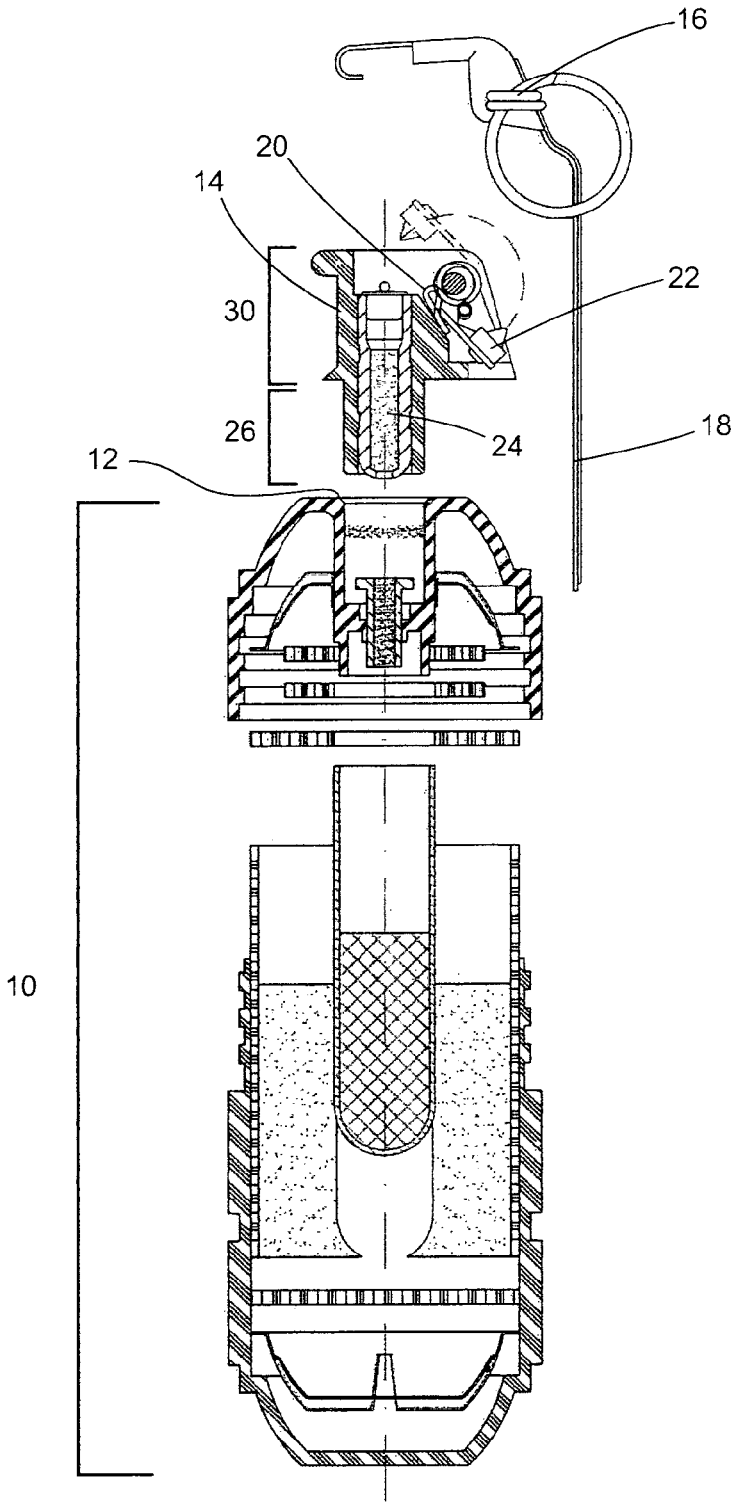
FIG. 1 is an exploded side sectional view of the grenade according to the present invention.
Figure 2:
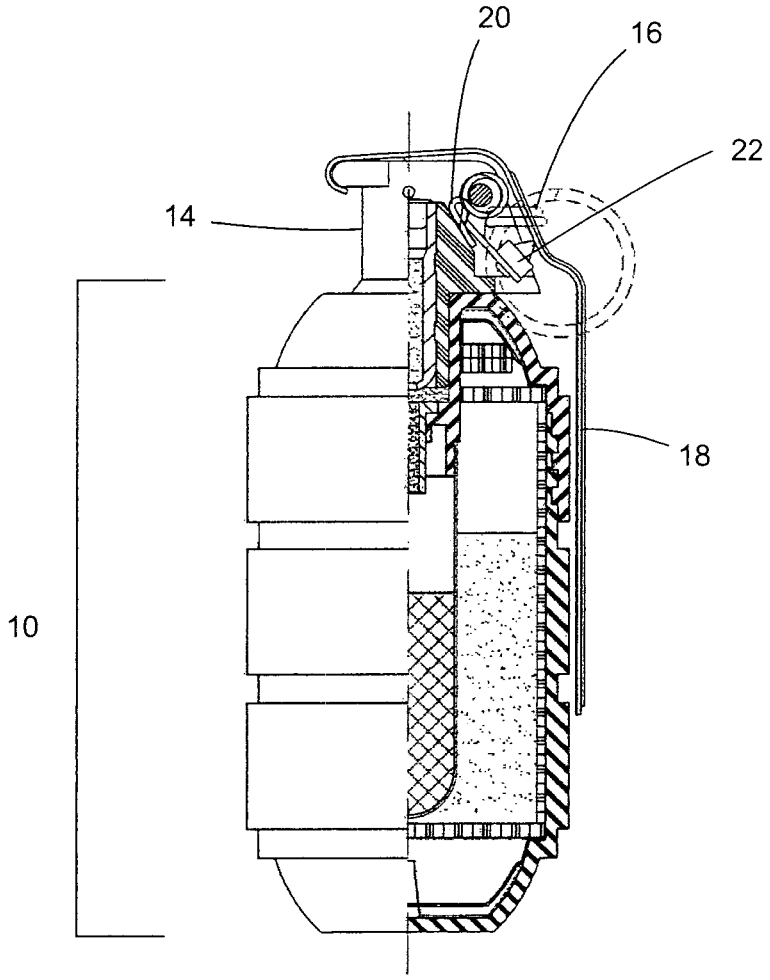
FIG. 2 is a partly sectioned side view of the grenade according to the present invention.

FIGS. 1 and 2 show a grenade according to the present invention. Thus, it is provided a main body 10 of the grenade, which may have a variety of shapes, such as cylindrical, ovoid, spherical, or other shapes selected according to the usefulness of the application intended.

The main body 10 holds a charge to be released (not shown), the main functioning of which is known to any person skilled in the art. The body 10 has an opening 12, generally arranged at the upper part thereof, in which the grenade actuator 14 is mounted.

The actuator 14 is preferably of the EOT-type (short for "Espoleta de Ogiva de Tempo" in Portuguese or time fuse point in English), provided with a pull-ring-and-safety-clamp system.

The detonation system is actuated by removing the safety clamp 16 and then raising the percussion lever 18. Once the movement of said lever 18 has been initiated, a spring system 20 triggers the course of a loop 22, as can be observed from the path illustrated with dashed line in FIG. 1.

Said loop 22 strikes on the fuse, which actuates a delay column 24. The path of said delay column 24, according to the present invention, has two detonation stages, wherein the first stage has a charge that is sufficient to eject the actuator from the opening 12, away from the main body 10; and a second stage, which effectively triggers the detonation of the grenade.

Thus, once the actuator is ejected from the grenade, it remains intact, maintaining the automatic-identification device imbedded therein.

Figure 3:
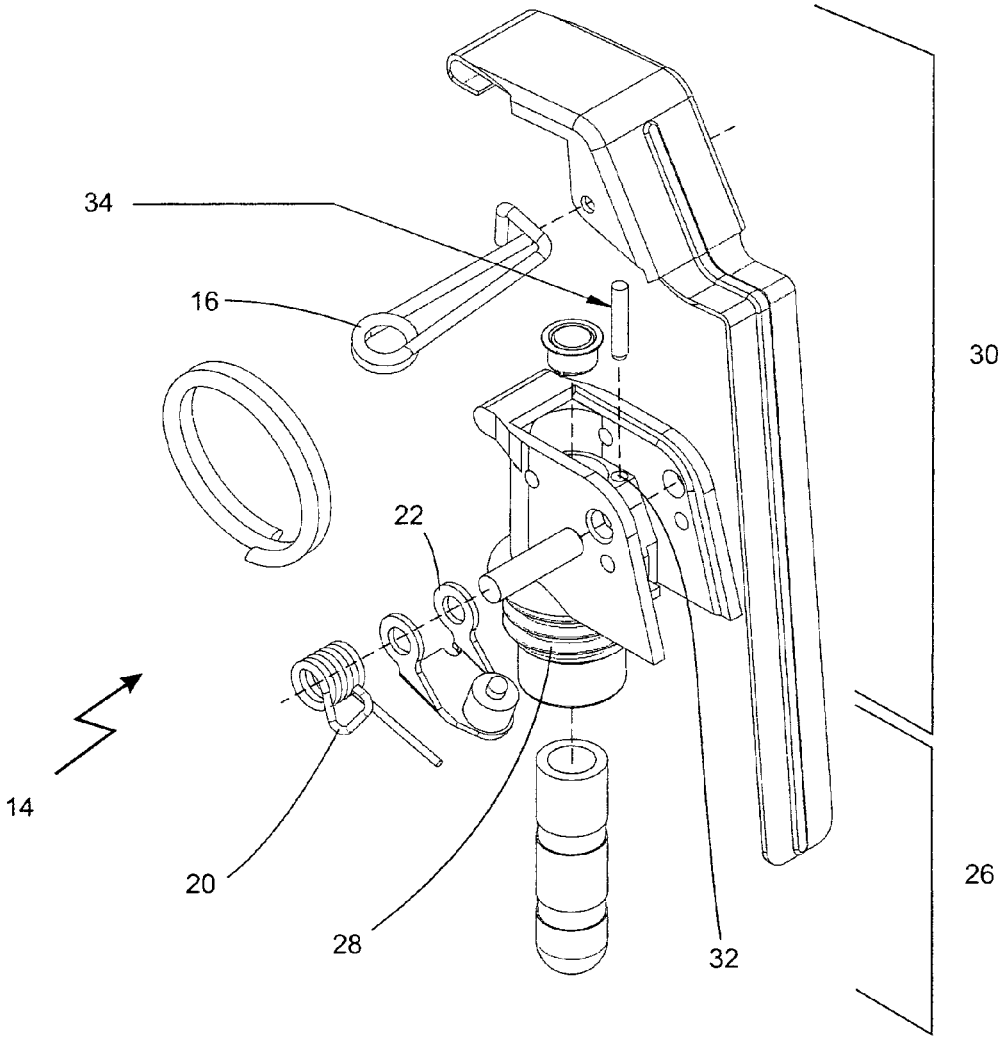
FIG. 3 is an exploded perspective view of the grenade actuator, also according to an embodiment of the present invention.
Figure 4:
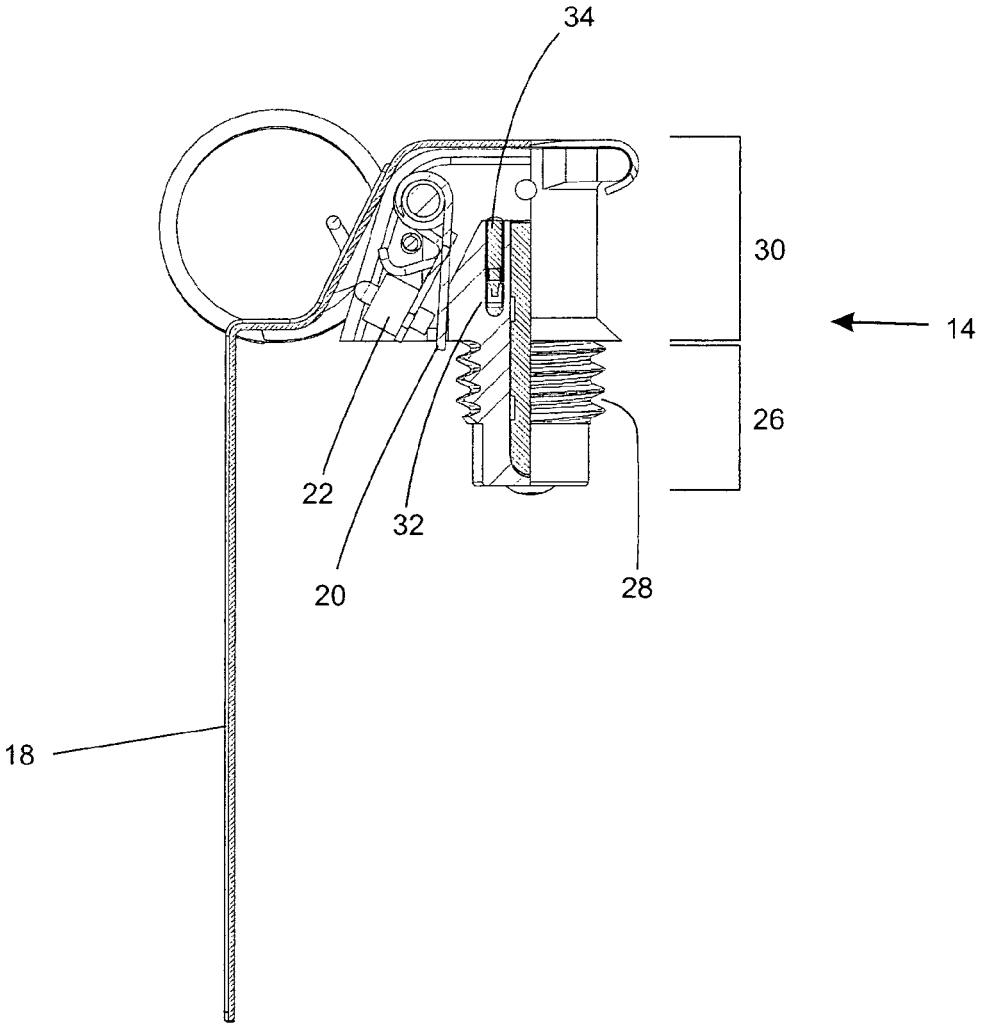
FIG. 4 is a partly sectioned side view of the grenade actuator according to the present invention.

As described above, the actuator 14 according to the present invention is of the EDT-type (Espoleta de Ogiva de Tempo—time fuse point), shown in detail in FIGS. 3 and 4 which has a body usually made of rigid polymer, comprising a lower portion 26 for fixation to the grenade opening 12. The lower section 26 consists of a cylindrical structure, wholly or partially provided with a thread turn 28 or any other means for fixation, releasable by detonation, to the opening 12.

The upper portion 30 of the actuator is integral with the lower portion and has a loop 22, which is kept in locked position by means of the percussion lever 18. The lever 18 is also kept in locked position by means of a safety clamp 16, which may be removed by action of the user of the grenade.

Thus, once the safety clamp 16 is removed and the movement of the lever 18 is triggered, the loop equally starts its course towards the fuse, which, as explained above, actuates the delay column of the grenade.

Indeed, and in order to achieve the objectives proposed by the present invention the actuator 14 has a housing 32, inside of which the automatic-identification device 34 is arranged.

The location of said housing 32 for the identification device 34 is selected so that:

(i) the installation of the identification device can be made at the time of mounting the actuator;

(ii) the removal of the identification device after mounting the actuator will be impossible or at least substantially difficult, without starting the detonation stages described above; and (iii) the reading of the identification device will be viable by means of an equipment suitable for this procedure.

The preferred embodiment of the invention to achieve the objectives outlined in the above items (i), (ii) and (iii) consists in providing a radiofrequency-identification device (RFID) disposed under the percussion lever, so that any attempt to remove it would necessarily imply in detonation of the grenade.

Therefore, for this purpose, the RFID device 34 consists of a cylindrical rod with dimensions suitable for insertion into an equally cylindrical housing, which is arranged in the actuator body, as already described, at a position hidden under the percussion lever.

Once the RFID device 34 has been inserted into the housing 32, this housing must be duly closed by any adequate means, such as gluing, adhesive application, etc, so as to prevent release of the RFID device after actuation of the grenade.

The tracing of the actuator and of the grenade according to the present invention occur by means of a so-called RFID reader (not shown). As it is known to a person skilled in the art, this reader consists of a radiofrequency transceiver, which operates at a standard frequency for the intended application.

On the other hand, the RFID device, also called RFID tag, consists of a transponder that responds to commands received from the reader. Considering the desired function of the present invention, the transponder will preferably be of the passive type, that is, it will not be provided with any integrated power source.

Thus, once the grenade has been detonated, and by scanning the area where the actuator might be, by means of a RFID reader, it is possible to make its complete identification with information from the manufacturer, origin, distribution, storage and the receiver of the artifact after tracing it down.

Such a possibility opens a wide range of advantages of the grenade and actuator of the present invention over the prior art. Thus, taking into consideration the great importance of the safety that involves all the aspects relating to this type of artifact, it becomes possible to have a much more adequate control of the whole logistic chain of the artifacts distribution, from the manufacture to the delivery to the buyer. Such an advantage is a complement to the already referred-to possibility of tracing the actuator after detonation of the grenade.

Another embodiment of the present invention refers to the method of manufacturing an actuator for a hand grenade. According to the method of the present invention, an EOT-type actuator (Espoleta de Ogiva de Tempo, time fuse point) is manufactured in the usual way and is already known to those skilled in the art, being inventive and characterized by the step of providing a housing for the automatic-identification device in the actuator body.

Indeed, the method of manufacturing the actuator further includes providing said housing with a cylindrical shape and subsequently inserting an equally cylindrical automatic-identification device into said housing.

The shapes and materials described herein are not limitative, since any materials suitable for the grenade actuator could be used. It is also possible, without departing from the protection scope of the present invention that the manufacturer should deem it appropriate to arrange the RFID device in another location in the actuator than that disclosed above, thus making the manufacture thereof more simple and economical.

Other modifications within the spirit and of the concept of this invention, evident to a person skilled in the art after consideration of this specification, should also be regarded as being within the scope of the invention, as defined in the attached claims.

The invention claimed is:

1. A hand grenade comprising a main body (10), an actuator (14) releasable fixed to the main body (10), an actuator-ejection mechanism, and a charge to be released, wherein the hand grenade comprises an automatic-identification device (34) imbedded in the actuator, the actuator-ejection mechanism comprises a delay column with a first detonation stage having energy sufficient only to eject the actuator, and the delay column has a second stage capable of triggering detonation of the grenade.

2. A hand grenade according to claim 1, wherein the main body (10) has a cylindrical shape.

3. A hand grenade according to claim 1, wherein the main body (10) has a ovoid shape.

4. A hand grenade according to claim 1, wherein the main body (10) has a spherical shape.

5. A hand grenade according to claim 1, wherein the charge to be released is selected from the group consisting of an explosive charge, a smoke-producing charge, a tear-gas charge, and a pyrotechnical charge.

6. A hand grenade according to claim 1, wherein the actuator (14) is of the EOT-type (Espoleta de Ogiva de Tempo, time fuse point), with a pull-ring and a safety clamp.

7. A hand grenade according to claim 1, wherein the actuator further comprises a housing (32) for the automatic-identification device (34).

8. A hand grenade according to claim 1, wherein the automatic-identification device (34) comprises a radiofrequency-identification device.

9. A hand grenade according to claim 8, wherein the radiofrequency-device has the shape of a cylindrical rod that can be inserted into an equally cylindrical housing.

* * * * *